United States Patent [19]

Swartz et al.

[11] 3,980,143

[45] Sept. 14, 1976

[54] HOLDING WRENCH FOR DRILL STRINGS

[75] Inventors: Richard H. Swartz; Richard J. Pearce; James M. Bowe, all of Gainesville, Fla.

[73] Assignee: Driltech, Inc., Gainesville, Fla.

[22] Filed: Sept. 30, 1975

[21] Appl. No.: 618,177

[52] U.S. Cl. ..... 173/100; 81/52.3; 81/57.16; 173/164; 175/85; 166/77.5; 166/315

[51] Int. Cl.[2] ..... E21B 3/00

[58] Field of Search ..... 173/164, 100, 93, 94; 175/85; 81/54, 57.16, 57.2, 57.19, 57.34, 57.44, 52.3; 29/240; 166/77.5, 315

[56] References Cited

UNITED STATES PATENTS

| | | | |
|---|---|---|---|
| 2,570,080 | 10/1951 | Stone | 173/164 |
| 3,239,016 | 3/1966 | Alexander | 173/164 |
| 3,291,225 | 12/1966 | Foran | 173/164 |
| 3,446,284 | 5/1969 | Dyer et al. | 173/164 |
| 3,463,247 | 8/1969 | Klein | 173/164 |
| 3,708,024 | 1/1973 | Back | 175/52 |
| 3,771,389 | 11/1973 | Coyne | 175/85 |

*Primary Examiner*—Ernest R. Purser
*Assistant Examiner*—Richard E. Favreau
*Attorney, Agent, or Firm*—A. Yates Dowell, Jr.

[57] ABSTRACT

Apparatus for holding and supporting a string of connected drill pipe sections which are suspended in a bore hole and for assisting in separating one drill pipe section from the string when the string is being disassembled.

5 Claims, 5 Drawing Figures

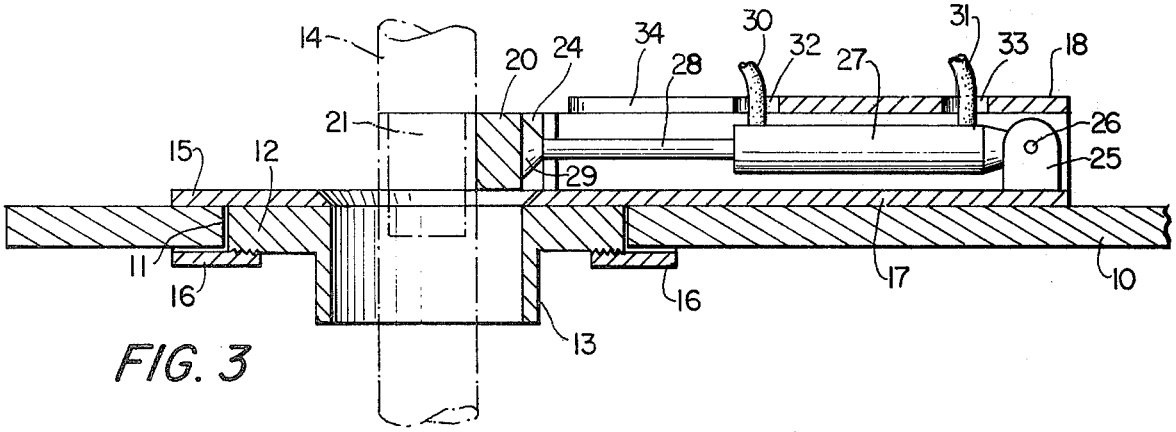
FIG. 3
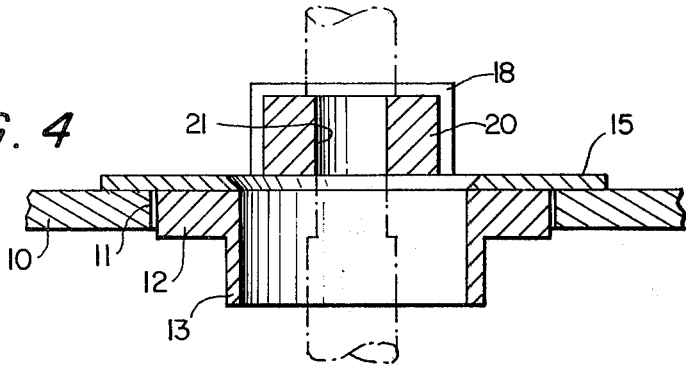
FIG. 4
FIG. 5
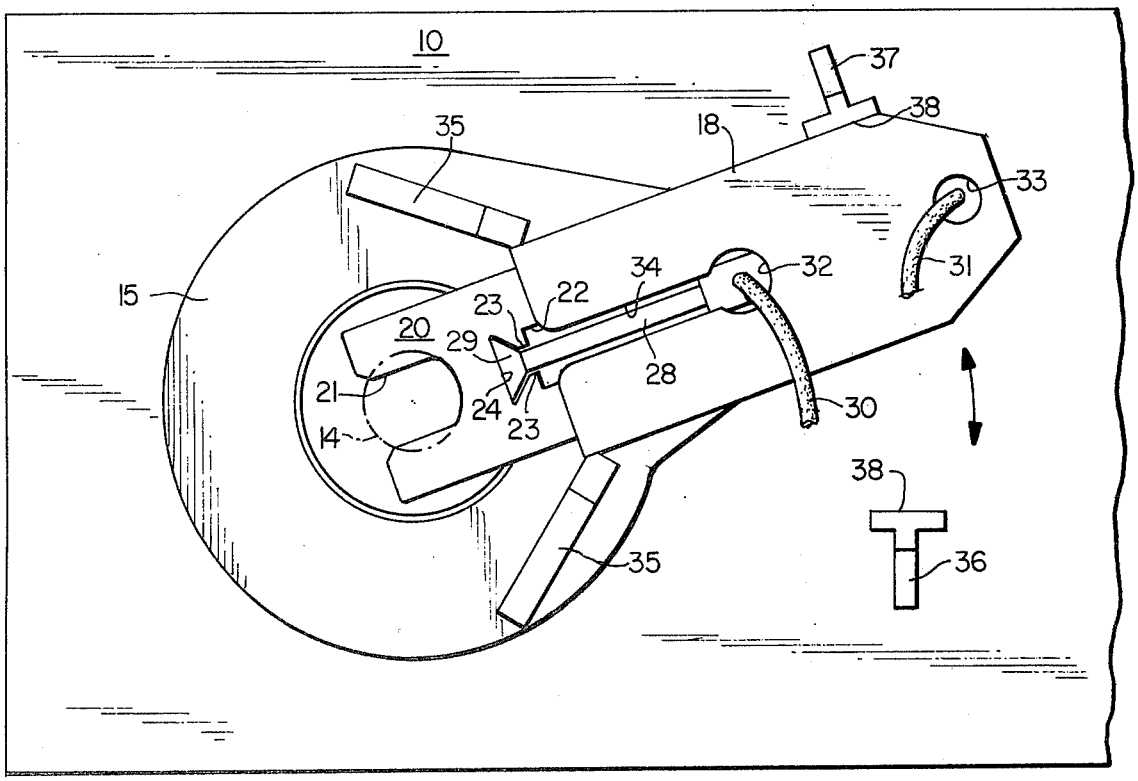

HOLDING WRENCH FOR DRILL STRINGS

BACKGROUND OF THE INVENTION

1. Field of the Invention.

This invention relates generally to apparatus for drilling a well or bore hole in the earth using a plurality of drill pipe sections joined in end-to-end relationship with a cutter head or drill on the lowermost end and relates particularly to apparatus for selectively supporting or holding the drill string and assisting in "breaking" the connection between pipe sections when the string is being disassembled.

2. Description of the Prior Art.

In the past, most vertically disposed drill rigs have included a drill table located close to the earth and having an opening through which the drill string extended. These prior art structures usually have included a clamp mechanism located adjacent to the drill table and such clamp mechanism was arranged so that a pair of jaws could be actuated to clampingly engage a pair of opposed flattened portions adjacent to the upper end of each drill pipe section. These clamping mechanisms were satisfactory for holding the drill string; however, it was usually necessary to provide a separate break wrench to start separation of the upper drill pipe section from the remainder of the string during disassembly. The break wrench has been necessary since each drill pipe section usually has a reduced threaded stud which engages a threaded opening in the end of the next adjacent pipe section. During the drilling operation, the drill string is rotated in a direction to tighten the cooperating screw threads. The break wrench ordinarily is sufficient to start separation of the drill pipe sections but when such wrench fails to break the threaded connection, substantial manual labor has been required with the assistance of chains or large stillson type wrenches to break the threads.

Some efforts have been made to improve the conventional clamping mechanisms by providing selectively operable holding wrenches to hold the drill string against rotation while the threaded connection has been broken either by the power plant mounted on the drill rig or by a break wrench. Some examples of the prior art are disclosed in the U.S. Pat. Nos. to Alexander 3,239,016; Back 3,708,024; Coyne 3,771,389; and Dyer Re. 28,351.

SUMMARY OF THE INVENTION

The present invention is embodied in a holding wrench including a yoke slidably mounted within a housing and adapted to be extended and retracted by a fluid cylinder. The yoke has a generally U-shaped recess in its outer end of a size to receive the opposed flattened portions of a drill pipe section. The housing is mounted on a rotatable platform carried by the drill table and is located between a pair of spaced stop members secured thereto. During the drilling operation, the yoke is extended into engagement with the flattened portions of the uppermost drill pipe section so that the drill rig power plant may be disconnected from the string to permit another drill pipe section to be added. When the drill pipe string is being disassembled after the drilling operation has been completed, or when it is necessary to change the drill bit, the power plant of the drill rig is raised so that the uppermost drill pipe section is located entirely above the drill table after which the yoke is extended into engagement with the flattened portions of the next subjacent drill pipe section. Thereafter the power plant is operated in a reverse or unscrewing direction; however, if the connection between the first and second drill pipe sections does not "break", the rotatable platform may be moved from one stop member to the other and then moved rapidly by the power plant in the unscrewing direction to cause the housing to slam into the stop member and break the threaded connection between the drill pipe sections.

It is an object of the invention to provide a holding wrench for intermittently holding a drill string when another drill pipe section is to be added during the drilling operation, as well as holding the drill string when the drill string is being removed from the earth and disassembled in which the holding wrench is slidably mounted in a rotatable housing and such housing may be moved rapidly against the stop member to break the threads.

BRIEF DESCRIPTION OF THE DRAWINGS

FIG. 3 is a section on the line 3—3 of FIG. 2.

FIG. 4 is a section on the line 4—4 of FIG. 2.

FIG. 5 is a top plan view showing the wrench in extended and rotated position.

DESCRIPTION OF THE PREFERRED EMBODIMENT

Figure 1:
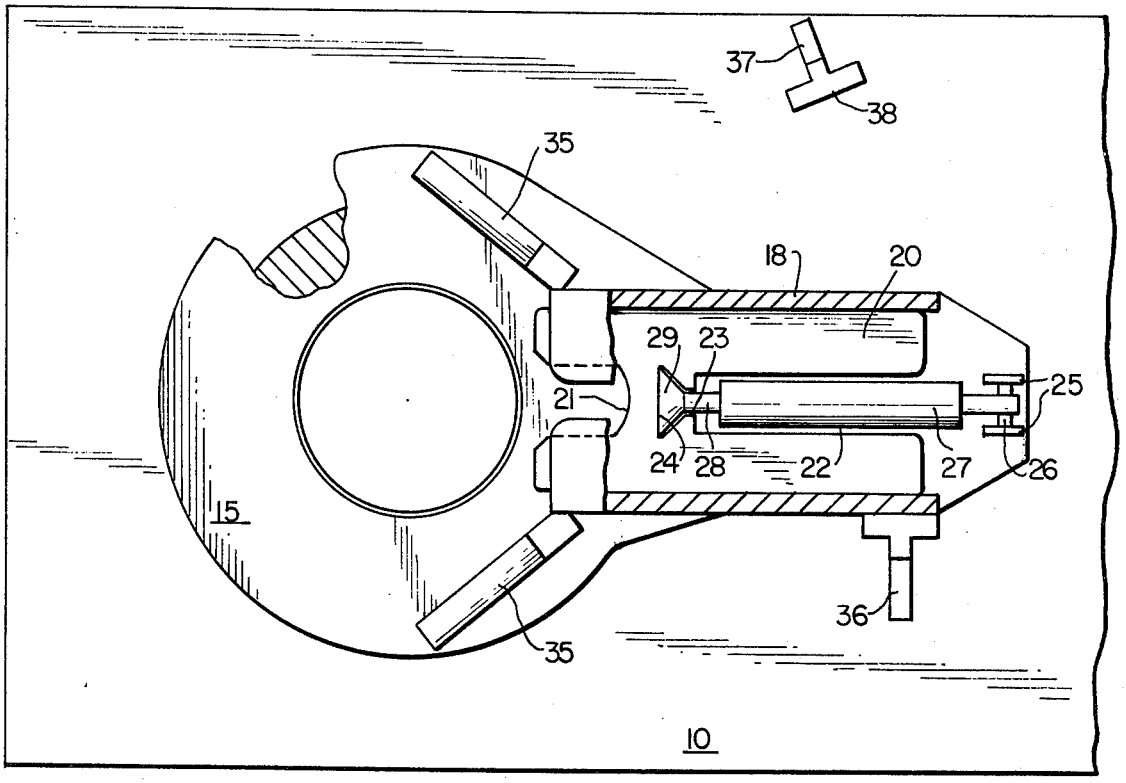
FIG. 1 is a top plan view with portions broken away to show the wrench in retracted position.
Figure 2:
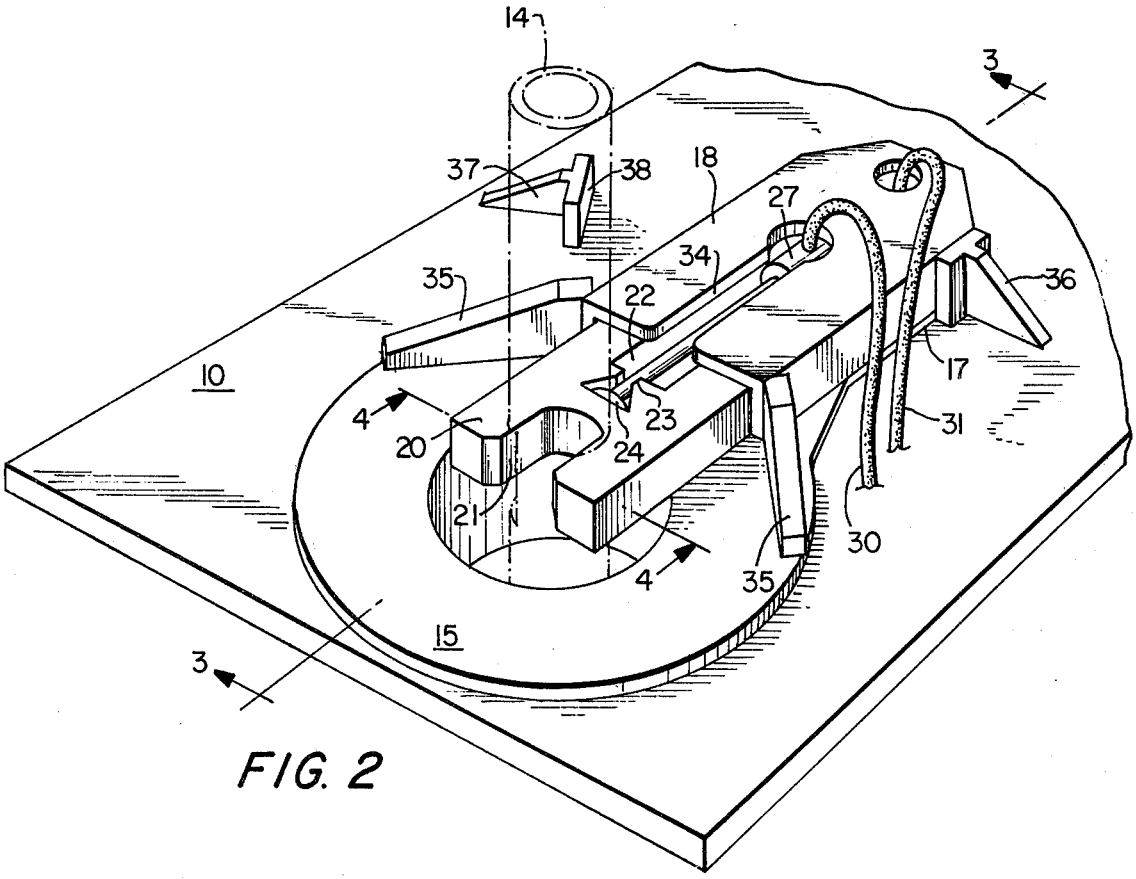
FIG. 2 is a perspective view illustrating the wrench in extended position.

With continued reference to the drawings, a conventional drill rig (not shown) is provided with a high torque power plant which is mounted on a frame and such frame is mounted for generally vertical movement on the rig. Adjacent to the lower end of the rig a drill table 10 is mounted in spaced relationship to the earth. An opening 11 is provided in the table 10 and such opening rotatably receives the collar 12 of a hollow tubular sleeve 13. The inner diameter of the sleeve 13 is large enough to permit a drill pipe section 14 to move axially therethrough.

A platform 15 is welded or otherwise attached to the upper portion of the collar 12 and such platform has an outer periphery which overlies and rests on a portion of the drill table 10. If desired, a plurality of anti-friction bearings or a bearing surface may be located between the periphery of the platform 15 and the drill table 10. With particular reference to FIG. 3, two or more outwardly extending lugs 16 may be welded or otherwise attached to the bottom of the collar 12 in overlapping relationship with a portion of the drill table 10 so that the collar 12 cannot be accidentally or easily removed from the opening 11. The platform 15 is provided with an elongated tang or extension 17 located generally radially of the sleeve 13 and a housing 18 is welded or otherwise attached thereto.

A yoke or holding member 20 is slidably mounted within the housing 18 and such yoke is provided with a generally U-shaped recess 21 in one end which is of a size to snugly receive the flattened portions of a drill pipe section 14. The opposite end of the yoke or holding member 20 has an elongated slot 22 extending inwardly therefrom and terminating in a pair of shoulders 23 which are in spaced relationship to each other. The shoulders communicate with a dovetail slot 24.

In order to extend and retract the yoke 20, a pair of upstanding ears 25 are mounted adjacent to the outer end of the tang 17 and such ears are connected by a pivot 26 to one end of a fluid cylinder 27. Such fluid cylinder has an extendable and retractable piston rod 28 with a generally frusto-conical push-pull head 29 mounted on its outer end. The head 29 is slidably received within the dovetail slot 24 which confines the head in back-and-forth directions. Fluid lines 30 and 31 connect the opposite ends of the fluid cylinder 27 to a fluid motor and reservoir (not shown) so that fluid under pressure can be selectively introduced through either of the fluid lines and discharged through the other fluid line to cause the piston rod 28 to be extended or retracted. Such fluid lines extend through openings 32 and 33 in the upper wall of the housing 18 to the fluid cylinder 27. If desired, the opening 32 may communicate with the inner edge of the housing 18 by an inspection slot 34. Ordinarily a pair of braces 35 are welded or otherwise attached to the platform 15 and one end of each of such braces is in abutting relationship with the housing 18 to support the housing against lateral movement or bending.

A pair of spaced stop members 36 and 37 are welded or otherwise rigidly attached to the drill table 10 and each of such stop members is provided with an impact face 38 which is disposed generally radially of the sleeve 13 and substantially parallel with the housing 18 when the housing is rotated into intimate engagement with either of the impact faces.

In the operation of the device, during the drilling operation, a plurality of drill pipe sections 14 are connected together in end-to-end relationship by the threaded stud of one drill pipe section being received within the opening of an adjacent drill pipe section. The uppermost drill pipe section is connected to a threaded stud of the high torque power plant of the drill rig so that rotation of the power plant causes rotation of the drill string which, in turn, causes the cutter or drill bit at the opposite end of the string to penetrate the earth. While the power plant is rotating the drill string, the drill rig is lowering such power plant so that the drill bit continues to penetrate the earth.

When the power plant has been lowered to a point slightly above the drill table 10, the flattened portions adjacent to the upper end of the drill pipe section are aligned with the U-shaped recess of the yoke 20 after which the piston rod 28 is extended to cause the U-shaped recess to cooperatively receive the flattened portions of the drill pipe section. In this position the direction of rotation of the power plant is reversed to unscrew the power plant stud from the drill pipe section and if the threaded connection is broken the power plant stud is unscrewed after which the power plant is raised to receive another drill pipe section which is then screwed into the drill pipe section being held by the yoke 20.

If the reversing of the power plant should fail to break the threaded connection between the power plant stud and the drill pipe section, the power plant is rotated in a screwing direction. Since the drill pipe section cannot rotate relative to the yoke 20, the platform 15 is rotated within the opening 11 until the housing 18 engages one of the stop members 36 or 37. At this point the direction of rotation of the power plant is reversed and operated rapidly in an unscrewing direction which causes the housing 18 to swing around and engage the other stop member with a hard impact. The torque of the power plant normally is sufficient to break the threaded connection between the power plant stud and the drill pipe section.

After the drilling operation has been completed, or when it is necessary to change the drill bit at the lower end of the drill string, the power plant is raised so that the drill string is lifted until the uppermost drill pipe section is located above the drill table 10 and the flattened portions of the next subjacent pipe section are in alignment with the yoke 20. At this time the yoke is extended into engagement with the subjacent drill pipe section. The power plant then is rotated in a screwing direction to cause the platform 15 to rotate so that the housing 18 engages one of the stop members after which the direction of rotation of the power plant is reversed to swing the platform in the the opposite direction and strike the impact face of the other stop member with a hard impact force.

It is noted that the threads of the power plant stud are in the same direction as the threads on the lower end of the drill pipe section; however, when the power plant is rotated in an unscrewing direction, the torque which is applied to the uppermost drill pipe section and the sudden impact adjacent to the connection between the uppermost drill pipe section and the next adjacent drill pipe section causes the threaded connection between drill pipe sections to break instead of breaking the connection between the upper end of the drill pipe section and the power plant stud.

After the threaded connection between the drill pipe sections has been broken, continued rotation of the power plant unscrews the upper pipe section from the drill string after which the separated pipe section may be placed in a rack and disconnected from the power plant. The power plant then is lowered so that the power plant stud threadedly engages the opening in the upper end of the drill pipe section being held by the yoke after which the yoke is retracted, the power plant is raised to lift the drill string again, and the operation is repeated.

We claim:

1. Apparatus mounted on a drill table for selectively holding and supporting a string of drill pipe sections connected together in end-to-end relationship, each of said drill pipe sections having at least one flattened portion, said apparatus comprising a platform swingably mounted on the drill table, said platform having an opening through which the drill pipe sections are axially movable, a housing mounted on said platform, a holding member slidably mounted in said housing generally radially of said opening, said holding member having a recess extending inwardly from one edge and being of a size to cooperatively receive the flattened portion of a drill pipe section, means for selectively extending and retracting said holding member, at least one stop member mounted on the drill table in spaced relationship to said opening and in a position to engage said housing when said platform is swung in one direction, whereby said holding member is selectively movable into and out of engagement with a drill pipe section.

2. The structure of claim 1 including sleeve means carried by said platform and extending through an opening in the drill table.

3. The structure of claim 1 in which said means for selectively extending and retracting said holding member includes fluid cylinder means mounted on said platform, said cylinder means having a piston rod, and means for connecting said piston rod to said holding member.

4. The structure of claim 3 in which said means for connecting said piston rod to said holding member includes a generally frusto-conical head carried by said piston rod, and said holding member having a dovetail slot which cooperatively receives said head.

5. In a drill rig having a vertically movable frame, a power plant mounted on said frame, means on said power plant for threadedly engaging a drill pipe section having at least one flattened portion, said power plant being adapted to rotate said drill pipe section, a drill table located adjacent to the earth, said drill table being disposed generally normal to the axis of said drill pipe section and having an opening through which said drill pipe section is axially movable, the improvement comprising a platform swingably mounted on said drill table, said platform having an opening through which said drill pipe section is axially movable, a housing mounted on said platform, a holding member slidably mounted in said housing generally radially of said platform opening, said holding member having a recess of a size to cooperatively receive the flattened portion of said drill pipe section, means for selectively extending and retracting said holding member, at least one stop member mounted on said drill table in spaced relationship to said platform opening and in a position to engage said housing when said platform is rotated in one direction, whereby said holding member may be extended into cooperative engagement with the flattened portion of said drill pipe section and thereafter said power plant is rotated in a first direction to swing said housing away from said stop member and then is rotated in a reverse direction to cause said housing to strike said stop member to break the threaded connection between the power plant and said drill pipe section.

* * * * *